US012139243B2

(12) United States Patent
Liu et al.

(10) Patent No.: US 12,139,243 B2
(45) Date of Patent: Nov. 12, 2024

(54) APPARATUS, METHOD AND COMPUTER PROGRAM FOR CONTROLLING PROPULSION OF MARINE VESSEL

(71) Applicant: ABB Schweiz AG, Baden (CH)

(72) Inventors: Bin Liu, Västerås (SE); Veli-Pekka Peljo, Helsinki (FI); Peter Fransson, Västerås (SE); Arne Trangärd, Västerås (SE); Wei Ji, Stockholm (SE); Winston Garcia-Gabin, Solna (SE); Kateryna Mishchenko, Västerås (SE); Jari Kivelä, Helsinki (FI); Kai Karila, Helsinki (FI); Matti Kivioja, Helsinki (FI)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 18/001,360

(22) PCT Filed: Jun. 11, 2020

(86) PCT No.: PCT/EP2020/066194
§ 371 (c)(1),
(2) Date: Dec. 9, 2022

(87) PCT Pub. No.: WO2021/249645
PCT Pub. Date: Dec. 16, 2021

(65) Prior Publication Data

US 2023/0234686 A1 Jul. 27, 2023

(51) Int. Cl.
*B63H 1/10* (2006.01)

(52) U.S. Cl.
CPC ..... *B63H 1/10* (2013.01)

(58) Field of Classification Search
None
See application file for complete search history.

(56) References Cited

U.S. PATENT DOCUMENTS 3,700,349 A * 10/1972 Fork ..... B63H 1/10 416/111
4,752,258 A * 6/1988 Hochleitner ..... B63H 1/10 440/93

(Continued)

FOREIGN PATENT DOCUMENTS

CN 109470447 A 3/2019
DE 20117451 U1 4/2002

(Continued)

OTHER PUBLICATIONS

International Preliminary Report on Patentability; Application No. PCT/EP2020/066194; Completed: May 18, 2022; 6 Pages.

(Continued)

*Primary Examiner* — Kayla Mccaffrey
(74) *Attorney, Agent, or Firm* — Whitmyer IP Group LLC

(57) ABSTRACT

An apparatus, method and computer program for controlling propulsion of marine vessel. The propulsion is implemented by a foil wheel propulsion system. The method includes: receiving a wheel operation status from a wheel drive; receiving a plurality of foil operation statuses from a plurality of foil drives; receiving a command from a vessel control system; generating wheel control data for the wheel drive to control a foil pitch function of the foil wheel propulsion system based on the command in view of the wheel operation status; and generating foil control data for the plurality of the foil drives to further control the foil pitch function of the foil wheel propulsion system based on the command in view of the wheel operation status and the plurality of foil operation statuses, wherein a reference torque of the foil control data for each foil drive is generated using a foil feedforward model.

15 Claims, 8 Drawing Sheets

(56) References Cited

U.S. PATENT DOCUMENTS

| | | | | |
|---|---|---|---|---|
| 7,686,583 | B2 * | 3/2010 | Siegel | F03B 17/067 416/111 |
| 2015/0321740 | A1 * | 11/2015 | Bradley | B63H 1/10 416/1 |

FOREIGN PATENT DOCUMENTS

| | | | |
|---|---|---|---|
| DE | 10060067 | A1 | 6/2002 |
| EP | 2944556 | B1 | 7/2018 |
| JP | 2001500453 | A | 1/2001 |
| JP | 2007246082 | A | 9/2007 |
| WO | 9812104 | A1 | 3/1998 |

OTHER PUBLICATIONS

International Search Report and Written Opinion of the International Searching Authority; Application No. PCT/EP2020/066194; Mar. 5, 2021; Mailing Date: Mar. 17, 2021; 12 Pages.
Japanese Office Action Translation; Application No. 2022-575909; Completed: Nov. 21, 2023; Mailing Date: Nov. 29, 2023; 5 Pages.

* cited by examiner

APPARATUS, METHOD AND COMPUTER PROGRAM FOR CONTROLLING PROPULSION OF MARINE VESSEL

TECHNICAL FIELD

Various embodiments relate to an apparatus for controlling propulsion of a marine vessel, a method for controlling propulsion of a marine vessel, and computer program code for controlling propulsion of a marine vessel.

BACKGROUND

A foil wheel propulsion system generates thrust by a combined action of a rotation of a fixed point of foils around a centre and an oscillation of the foils that changes their angle-of-attack over time. Some implementations of such a propulsion system are also known as a cyclorotor, a trochoidal propeller, or a Voith-Schneider propeller (VSP). Traditionally, a wheel (or rotor) rotates, and foils (or blades) attached to the wheel change their angle of attack due to a mechanical coupling between the rotation of the wheel and the rotation of the foils.

DE 10060067 A1 discloses a system wherein each foil is separately adjustable, independent of the adjustment of the rotor.

EP 2944556 B1 discloses a control map or an algorithm using various inputs for controlling disc rotation and independent blade rotations.

However, further sophistication in the control of the foil wheel propulsion system is desirable.

SUMMARY

According to an aspect, there is provided subject matter of independent claims. Dependent claims define some embodiments.

One or more examples of implementations are set forth in more detail in the accompanying drawings and the description of embodiments.

BRIEF DESCRIPTION OF THE DRAWINGS

Some embodiments will now be described with reference to the accompanying drawings, in which.

DETAILED DESCRIPTION

The following embodiments are only examples. Although the specification may refer to "an" embodiment in several locations, this does not necessarily mean that each such reference is to the same embodiment(s), or that the feature only applies to a single embodiment. Single features of different embodiments may also be combined to provide other embodiments. Furthermore, words "comprising" and "including" should be understood as not limiting the described embodiments to consist of only those features that have been mentioned and such embodiments may contain also features/structures that have not been specifically mentioned.

Reference numbers, both in the description of the embodiments and in the claims, serve to illustrate the embodiments with reference to the drawings, without limiting it to these examples only.

The embodiments and features, if any, disclosed in the following description that do not fall under the scope of the independent claims are to be interpreted as examples useful for understanding various embodiments of the invention.

Figure 1:
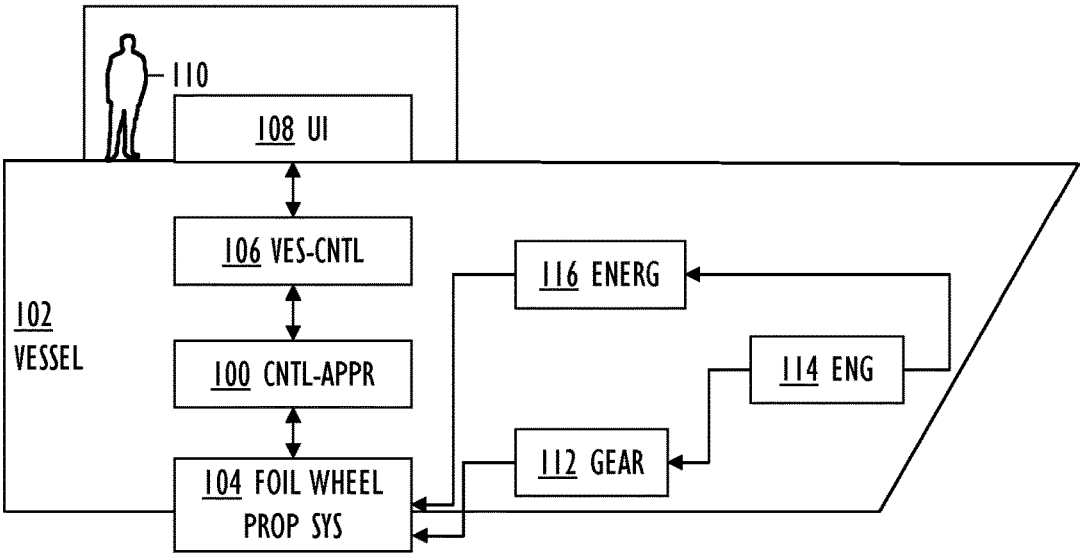
FIG. 1 and FIG. 2 illustrate embodiments of an apparatus for controlling propulsion of a marine vessel.
Figure 2:
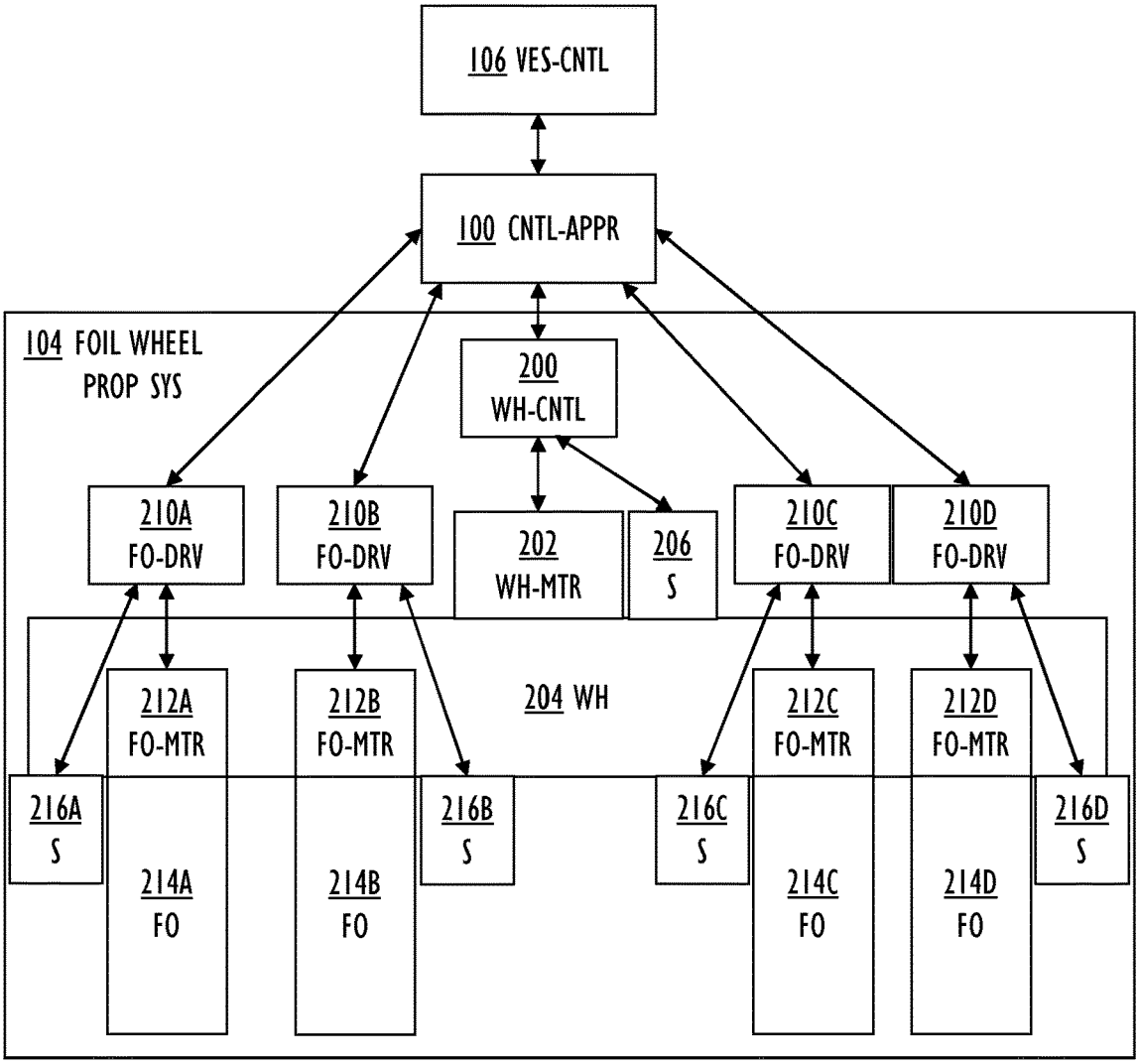
Figure 5:
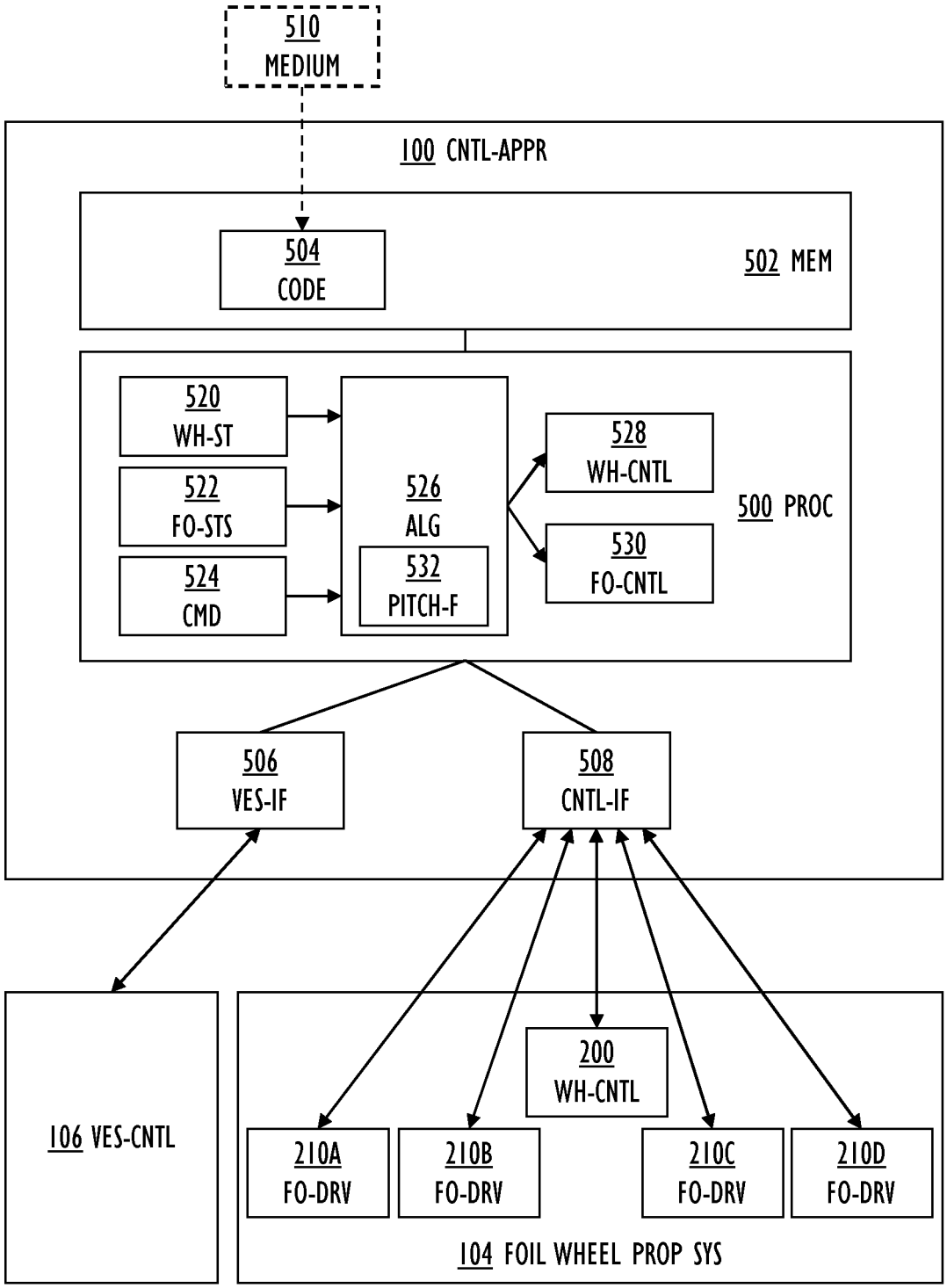
FIG. 5 illustrates further embodiments of the apparatus for controlling propulsion of the marine vessel.
Figure 6:
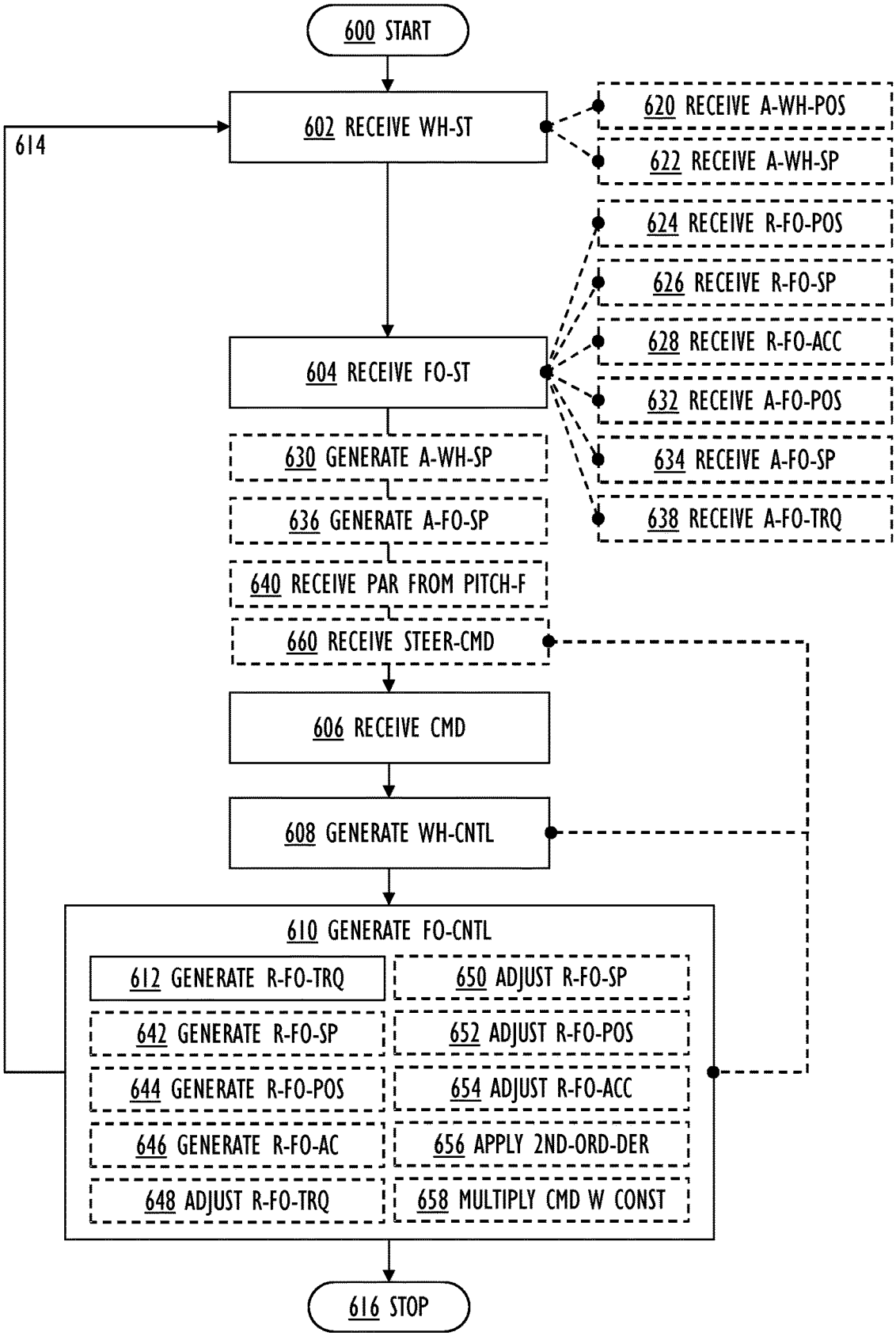
FIG. 6 is a flow chart illustrating embodiments of a method for controlling propulsion of a marine vessel.

Let us study simultaneously FIG. 1, FIG. 2 and FIG. 5, which illustrate embodiments of an apparatus 100 for controlling propulsion of a marine vessel 102, and FIG. 6, which illustrates embodiments of a method for controlling propulsion of the marine vessel 102. The method may be implemented as an algorithm 526 programmed as computer program code 504, executed by the apparatus 100 as a special purpose computer.

The apparatus 100 comprises a vessel interface 506 couplable with a vessel control system 106. The vessel control system 106 may interact with a mariner 110 through a user interface 108. The mariner 110 is the person who navigates the marine vessel 102 or assists as a crewmember: a captain, a navigating officer, an officer, an officer of the watch, a helmsman, or other deck crew member, or even a pilot. The user interface 108 implements the presentation of graphical, textual and possibly also auditory information to the mariner 110. The user interface may be used to perform required user actions in relation to maneuvering the marine vessel 102 such as giving propulsion and steering commands. The user interface may be realized with various techniques, such as a rudder, display, keyboard, keypad, buttons, levers, switches, means for focusing a cursor (mouse, track ball, arrow keys, touch sensitive area, etc.), elements enabling audio control, etc. The propulsion and steering commands may relate to a rudder pitch, a driving pitch, and a revolution, for example.

The apparatus 100 also comprises a control interface 508 to control a foil wheel propulsion system 104.

The foil wheel propulsion system 104 comprises a rotatable wheel 204 and a plurality of rotatable foils 214A, 214B, 214C, 214D attached perpendicularly to the wheel 204.

Figure 3A:
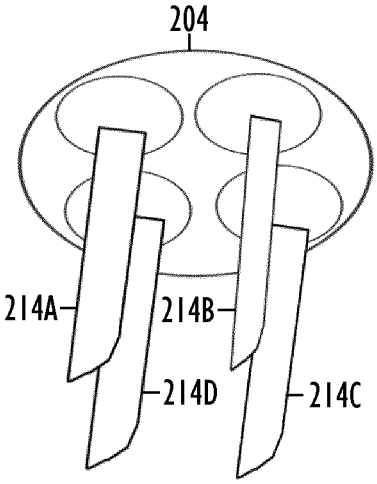
FIG. 3A and FIG. 3B illustrate embodiments of a foil wheel propulsion system.
Figure 3B:
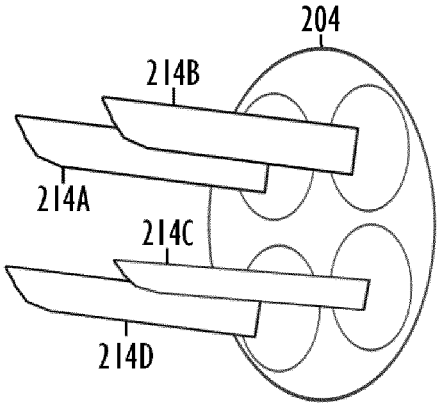

As shown in FIG. 3A, the wheel 204 may be configured to rotate in a substantially horizontal level, substantially parallel to a bottom of the marine vessel 102, and each foil 214A, 214B, 214C, 214D is configured to rotate in a substantially vertical level. In an embodiment, the number of the foils 214A, 214B, 214C, 214D is four, but the number of the foils 214A, 214B, 214C, 214D may vary so that there are less (such as two) or more foils 214A, 214B, 214C, 214D. The foils 214A, 214B, 214C, 214D may be arranged symmetrically around a rotation axis of the wheel 204. For each foil 214A, 214B, 214C, 214D, an eccentricity related to the rotation axis of the wheel 204 may be adjusted by the foil pitch function 532. As shown in FIG. 3B, the wheel 204 may alternatively be configured to rotate in a substantially vertical level, substantially perpendicular in relation to the bottom of the marine vessel 102, and each foil 214A, 214B, 214C, 214D is configured to rotate in a substantially horizontal level.

The rotatable wheel 204 is powered by a wheel motor 202 and controlled by a wheel controller 200.

Each foil 214A, 214B, 214C, 214D is powered by a foil motor 212A, 212B, 212C, 212D and controlled by a foil drive 210A, 210B, 210C, 210D.

In an embodiment, each motor 212A, 212B, 212C, 212D is an electric motor, and each drive 210A, 210B, 210C, 210D is a controller of the electric energy sent to the motor 202, 212A, 212B, 212C, 212D. In an embodiment, each drive 210A, 210B, 210C, 210D is an inverter such as ABB HES880 mobile drive.

In an embodiment, the wheel motor 202 is an electric motor, and the wheel controller 200 is a wheel drive configured to control electric energy sent to the electric motor 202. In an embodiment, the wheel drive 200 is an inverter such as ABB ACS600 drive.

In an embodiment, the wheel motor 202 is an engine 114, and the wheel controller 200 is configured to electrically control the engine 114. The wheel controller 200 may be configured to change the speed (RPM) of the engine 202, 114, for example. As shown in FIG. 1, one or more gearboxes 112 (connected in serial) are configured to transmit mechanical power from the engine 114 to the wheel 204.

Naturally, the electric energy consumed by the electric motors 202, 212A, 212B, 212C, 212D may be produced by any suitable technology usable in the marine vessel 102, including, but not limited to: one or more engines such as diesel motors or a petrol engine, and/or one or more other types of electric energy sources such as a renewable electric energy source, a power plant, or an electric energy storage 116 such as a set of batteries and/or a set of (super) capacitors. Naturally, the engine 114 or the power plant may be used to produce the electric energy stored in the electric energy storage 116.

In an embodiment, the wheel motor 202 is the engine 114 (such as a diesel motor, for example), controlled by the suitable wheel controller 200, whereas the foil motors 212A, 212B, 212C, 212D are electric motors controlled by the foil drives 210A, 210B, 210C, 210D. The engine 114 may be operated with optimum (from the point of view of Specific Fuel Oil Consumption or SFOC) speed, and the described control of the foil pitch function 532 may be used to adjust the needed thrust instead of adjusting the engine 114 speed. This enables multiple configurations in case of hybrid propulsion with power take-off/power take-in (PTO/PTI), energy storages, etc. For example, during smaller propulsion power, the engine 114 is used to charge the batteries 116. The feedforward control may calculate the needed wheel 204 speed (rpm) in the case of the engine-powered wheel 204 and send the reference wheel speed to the control of the engine 114.

The foil wheel propulsion system 104 also comprises a wheel sensor 206 to measure an actual angular wheel position of the wheel 204, and a plurality of foil sensors 216A, 216B, 216C, 216D to measure an actual angular foil position of each foil 214A, 214B, 214C, 214D.

The kinematics of the foil wheel propulsion system may be defined with the equation 1:

$$\lambda = \frac{V_a}{\omega R}, \tag{1}$$

where:

$\lambda$ is the absolute advance coefficient, $v_a$ is the ship speed, $\omega$ is the rotation rate of the wheel, and R is the radius of the wheel.

Figure 4:
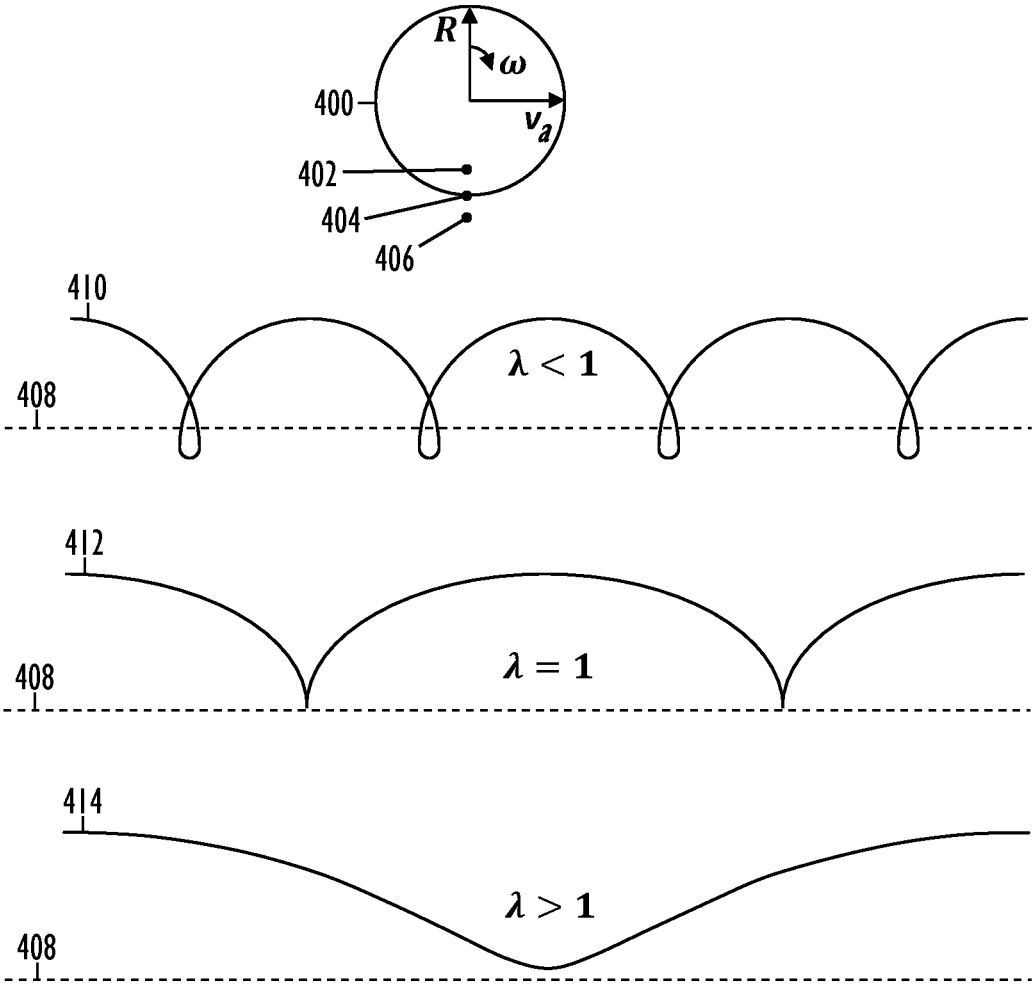
FIG. 4 illustrates embodiments of a foil path.

A trajectory of each foil 214A, 214B, 214C, 214D may be described by trochoids 410, 412, 414 illustrated in FIG. 4. The trochoid 410, 412, 414 is a roulette (curve) drawn by a fixed point on a circle 400 as it rolls along a straight line 408. If the point 406 is outside the circle 400, the prolate trochoid 410 is drawn. If the point 404 is on the circle 400, the common trochoid 412 is drawn. If the point 402 is inside the circle 400, the curtate trochoid 414 is drawn.

In an embodiment, each foil 214A, 214B, 214C, 214D is configured to propagate along the prolate trochoid 410, where $\lambda<1$ and which may also be called an epicycloidal trajectory, or along the curtate trochoid 414, where $\lambda>1$ and which may also be called a trochoidal trajectory.

Note that FIG. 1 only shows one foil wheel propulsion system 104, but the marine vessel 102 may also comprise one or more additional foil wheel propulsion systems 104, and also one or more other types of propulsion systems. In an embodiment, the apparatus 100 centrally controls more than one foil wheel propulsion systems 104 in order to further optimize system performance.

The apparatus comprises one or more memories 502 including computer program code 504, and one or more processors 500 to execute the computer program code 504 to cause the apparatus 100 to perform the method as an algorithm 526 for controlling the propulsion of the marine vessel 102.

The term 'processor' 500 refers to a device that is capable of processing data. Depending on the processing power needed, the apparatus 100 may comprise several processors 500 such as parallel processors, a multicore processor, or a computing environment that simultaneously utilizes resources from several physical computer units (sometimes these are referred as cloud, fog or virtualized computing environments). When designing the implementation of the processor 500, a person skilled in the art will consider the requirements set for the size and power consumption of the apparatus 100, the necessary processing capacity, production costs, and production volumes, for example.

The term 'memory' 502 refers to a device that is capable of storing data run-time (=working memory) or permanently (=non-volatile memory). The working memory and the non-volatile memory may be implemented by a random-access memory (RAM), dynamic RAM (DRAM), static RAM (SRAM), a flash memory, a solid state disk (SSD), PROM (programmable read-only memory), a suitable semiconductor, or any other means of implementing an electrical computer memory.

A non-exhaustive list of implementation techniques for the processor 500 and the memory 502 includes, but is not limited to: logic components, standard integrated circuits, application-specific integrated circuits (ASIC), system-on-a-chip (SoC), application-specific standard products (ASSP), microprocessors, microcontrollers, digital signal processors, special-purpose computer chips, field-programmable gate arrays (FPGA), and other suitable electronics structures.

The computer program code 504 may be implemented by software. In an embodiment, the software may be written by a suitable programming language, and the resulting executable code may be stored in the memory 502 and executed by the processor 500.

An embodiment provides a computer-readable medium 510 storing the computer program code 504, which, when loaded into the one or more processors 500 and executed by one or more processors 500, causes the one or more processors 500 to perform the algorithm/method, which will be explained with reference to FIG. 6. The computer-readable medium 510 may comprise at least the following: any entity or device capable of carrying the computer program code 504 to the one or more processors 500, a record medium, a computer memory, a read-only memory, an electrical carrier signal, a telecommunications signal, and a software distribution medium. In some jurisdictions, depending on the legislation and the patent practice, the computer-readable medium 510 may not be the telecommunications signal. In an embodiment, the computer-readable medium 510 may be a computer-readable storage medium. In an embodiment, the computer-readable medium 510 may be a non-transitory computer-readable storage medium.

The computer program code 504 implements the algorithm 526 for controlling the propulsion of the marine vessel 102. The computer program code 504 may be coded as a computer program (or software) using a programming language, which may be a high-level programming language, such as C, C++, or Java, or a low-level programming language, such as a machine language, or an assembler, for example. The computer program code 504 may be in source code form, object code form, executable file, or in some intermediate form. There are many ways to structure the computer program code 504: the operations may be divided into modules, sub-routines, methods, classes, objects, applets, macros, etc., depending on the software design methodology and the programming language used. In modern programming environments, there are software libraries, i.e. compilations of ready-made functions, which may be utilized by the computer program code 504 for performing a wide variety of standard operations. In addition, an operating system (such as a general-purpose operating system) may provide the computer program code 504 with system services.

In an embodiment, the one or more processors 500 may be implemented as one or more microprocessors implementing functions of a central processing unit (CPU) on an integrated circuit. The CPU is a logic machine executing the computer program code 504. The CPU may comprise a set of registers, an arithmetic logic unit (ALU), and a control unit (CU). The control unit is controlled by a sequence of the computer program code 504 transferred to the CPU from the (working) memory 502. The control unit may contain a number of microinstructions for basic operations. The implementation of the microinstructions may vary, depending on the CPU design.

In an embodiment, the apparatus 100 may be a stand-alone apparatus 100 as shown in FIG. 1, i.e., the apparatus 100 is a separate integrated unit, distinct from the vessel control system 106 and the foil wheel propulsion system 104.

However, in an alternative embodiment, at least a part of the structure of the apparatus 100 may be more or less distributed with another apparatus. In an embodiment, the apparatus 100 functionality is distributed within the actors shown in FIG. 2. Consequently, the apparatus 100 may be implemented within the stand-alone apparatus 100, and/or within the wheel controller 200, and/or within one or more of the foil drives 210A, 210B, 210C, 210D. In this way, the distributed processing power may be utilized as enabled by the actual implementation.

In another embodiment, the apparatus 100 is a networked server apparatus accessible through a communication network. The networked server apparatus 100 may be a networked computer server, which interoperates with the vessel control system 106 and the foil wheel propulsion system 104 according to a client-server architecture, a cloud computing architecture, a peer-to-peer system, or another applicable computing architecture.

The communication between actors 100, 104, 106, 108 may be implemented with a suitable standard/proprietary wireless/wired communication protocol, such as an industrial control bus, Ethernet, Bluetooth, Bluetooth Low Energy, Wi-Fi, WLAN, Zigbee, etc.

Let us now study the algorithm/method with reference to FIG. 6.

The method starts in 600 and ends in 616. Note that the method may run as long as required (after the start-up of the apparatus 100 until switching off) by looping 614 from an operation 610 back to an operation 602.

The operations are not strictly in chronological order in FIG. 6, and some of the operations may be performed simultaneously or in an order differing from the given ones. For example, operations 602, 604, 606 may be executed in a different sequential order or even in parallel. Other functions may also be executed between the operations or within the operations and other data exchanged between the operations. Some of the operations or part of the operations may also be left out or replaced by a corresponding operation or part of the operation. It should be noted that no special order of operations is required, except where necessary due to the logical requirements for the processing order.

In 602, a wheel operation status 520 is received from the wheel controller 200.

In 604, a plurality of foil operation statuses 522 are received from a plurality of foil drives 210A, 210B, 210C, 210D.

In 606, a command 524 is received from the vessel control system 106.

In 608, wheel control data 528 is generated for the wheel controller 200 to control a foil pitch function 532 of the foil wheel propulsion system 104 based on the command 524 in view of the wheel operation status 520.

In 610, foil control data 530 is generated for the plurality of the foil drives 210A, 210B, 210C, 210D to further control the foil pitch function 532 of the foil wheel propulsion system 104 based on the command 524 in view of the wheel operation status 520 and the plurality of foil operation statuses 522. As a part of 610, in 612, a reference torque of the foil control data for each foil drive 210A, 210B, 210C, 210D is generated using a foil feedforward model.

Note that in this application "reference" is a notation used for a set (or desired) control parameter value, whereas "actual" is used for a measured control parameter value.

The foil feedforward model refers to the nature of the control: the command 524 from the vessel control system 106 causes a predefined control of the foil pitch function 532 without responding to how the load of the foils 214A, 214B, 214C, 214D reacts. The control is based on a knowledge regarding the foil pitch function 532 in the form of a mathematical model and on a knowledge regarding disturbances. But a feedback is implemented by the use of the wheel operation status 520 the plurality of foil operation statuses 522. The wheel operation status 520 may include (set) reference control parameter values and (measured) actual control parameter values for the wheel 204. The foil operation statuses 522 may include (set) reference control parameter values and (measured) actual control parameter values for each foil 214A, 214B, 214C, 214D. Note that the control of the wheel 204 may be implemented by a wheel feedforward model.

To achieve high performance (e.g. high efficiency, high thrust, etc.) operation, the foil wheel propulsion system 104 needs to follow the predefined foil pitch function 532 with a high accuracy. However, there are several problems making a motion control of the foil wheel propulsion system 104 difficult. First, a foil pivot point typically is not aligned with a foil principal axis of inertia. A centrifugal torque will be induced due to this misalignment and the wheel rotation. Second, many high efficiency foil pitch functions 532 require a high acceleration and a high acceleration changing rate for the foil motion, which is difficult for the foil motors 212A, 212B, 212C, 212D and foil drives 210A, 210B, 210C, 210D to achieve. Third, for some foil pitch functions 532, such as the epicycloidal trajectory 410 (used by VSP, for example), the foil rotational speed changes rotational directions, which means the foil motors 212A, 212B, 212C, 212D need to compensate a friction torque. In addition to these problems, a hydrodynamic load applied on the foils 214A, 214B, 214C, 214D will also create a foil pitch function tracking error. Errors in following the specified foil pitch function 532 will lead to a degraded propeller performance, an increased wheel motor torque and a reduced efficiency.

The apparatus 100 and the method of FIG. 6 implement a motion control configuration method for the foils 214A, 214B, 214C, 214D powered by the foil motors 212A, 212B, 212C, 212D. The apparatus 100 receives commands 524 (a thrust command or another type of command related to the propulsion) from the (higher level) vessel control system 106, collects foil operation statuses 522 and the wheel operation status 520, and then creates foil control data 530 for every individual foil drive 210A, 210B, 210C, 210D and wheel control data 528 for the wheel controller 200 in order to control the foil pitch function 532. Every foil 214A, 214B, 214C, 214D may be in a position control mode, and the wheel 204 may be in a speed control mode or in a position control mode. Controlling every foil 214A, 214B, 214C, 214D with the position control mode enables precise control of the foil pitch function 532. Controlling the wheel 204 with the speed mode is a simple solution, whereas controlling the wheel 204 with the position control mode may enable some further functions, a side force compensation, for example. As the foil wheel propulsion system 104 is controlled as an integrated unit, an optimal system performance (as regards to an efficiency, a thrust, etc.) is achieved. The control may also enable further functions, such as maintaining system operation performance even if one or more foils 214A, 214B, 214C, 214D are in a failure mode.

In an embodiment, the reference torque is generated 612 as follows.

In 620, the actual angular wheel position is received as a part of the wheel operation status 520. In 622, an actual wheel speed is received as a part of the wheel operation status 520, or, alternatively, in 630, the actual wheel speed is generated based on a plurality of actual angular wheel positions. In 624, a reference angular foil position is received for each foil 214A, 214B, 214C, 214D as a part of the foil operation status 522. In 626, a reference foil speed is received for each foil 214A, 214B, 214C, 214D as a part of the foil operation status 522. In 628, a reference foil acceleration is received for each foil 214A, 214B, 214C, 214D as a part of the foil operation status 522.

In 612, the reference torque of the foil control data 530 is generated for each foil drive 210A, 210B, 210C, 210D using the feedforward model, whose inputs are the actual angular wheel position, the reference angular foil position, the actual wheel speed, the reference foil speed, and the reference foil acceleration. The reference torque is modified by a position feedback torque describing a difference in torque between the reference angular foil position and the actual angular foil position, and by a speed feedback torque describing a difference in torque between the reference foil speed and the actual foil speed.

The reference angular position $\theta_{foil_i_ref}$ for each foil may be defined with the equation 2:

$$\theta_{foil_i_ref} = \tan^{-1}\left(\frac{\cos\left(\theta_{wheel} + \frac{360}{N}\cdot i + \psi\right)}{e_c - \sin\left(\theta_{wheel} + \frac{360}{N}\cdot i + \psi\right)}\right), \tag{2}$$

where constants are defined:

N=number of foils per wheel, i=index of foil along wheel rotational direction, where sensor measurement signals are:

$\theta_{wheel}$=actual angular wheel position (0-360 degrees), $\theta_{foil_i_act}$=actual angular position (0-360 degrees) of the i:th foil, and where control commands are:

$e_c$=reference eccentricity, $\psi$=reference yaw angle, and $\tau_{i_ff}$=torque feedforward command for the i:th foil.

The reference torque $\tau_{i_total}$ for the i:th foil motor may be defined with the equation 3:

$$\tau_{i_total}=\tau_{i_pos_fb}(\theta_{foil_i_ref}-\theta_{foil_i_act})\tau_{i_speed_fb}(\Omega_{foil_i_ref}-\Omega_{foil_i_act})+\tau_{i_ff}(\theta_{wheel},\theta_{foil_i_ref},\Omega_{wheel},\Omega_{foil_i_ref},a_{foil_i_ref}) \tag{3}$$

where:

$\tau_{i_pos_fb}$=torque value from position feedback control for the i:th foil, $\tau_{i_speed_fb}$=torque value from speed feedback control for the i:th foil, $\tau_{i_ff}$=torque value from feedforward compensation for the i:th foil, $\Omega_{wheel}$=actual wheel speed (rotations per minute), $\Omega_{foil_i_act}$=reference foil speed for the i:th foil, $\Omega_{foil_i_ref}$=reference foil speed for the i:th foil, and $a_{foil_i_ref}$=reference foil acceleration for the i:th foil.

The above-described embodiment employing a model-based torque feedforward compensation provides an accurate torque value to compensate for a centrifugal torque, acceleration torque, friction torque and hydrodynamic torque, which all are difficult for the feedback control to realize.

This embodiment may be deployed with at least two different options in the foil drives 210A, 210B, 210C, 210D. In the first option, an external torque control mode is used. The position loop, speed loop and feedforward calculation are performed in the apparatus 100. The sum of the position loop, speed loop and feedforward value is sent to the foil drive 210A, 210B, 210C, 210D as the torque reference. In the second option, a speed controller mode is used. The speed control is running in the foil drive 210A, 210B, 210C, 210D. The position control and feedforward calculation are performed in the apparatus 100. The sum of position loop and feedforward value is sent to the foil drive 210A, 210B, 210C, 210D as the external torque reference. The second option utilizes foil drive 210A, 210B, 210C, 210D resources and reduces the load for the apparatus 100 and the communication between the apparatus 100 and the foil drives 210A, 210B, 210C, 210D.

In an embodiment illustrated with reference to FIG. 7 and FIG. 8, the reference torque is generated 612 as follows.

In 602, the actual angular wheel position is received as a part of the wheel operation status 520. In 632, the actual angular foil position for each foil 214A, 214B, 214C, 214D is received as a part of the foil operation status 522. In 634, an actual foil speed is received as a part of the foil operation status 522, or, alternatively, in 636, the actual foil speed is generated based on a plurality of actual angular foil positions. In 638, an actual foil torque for each foil 214A, 214B, 214C, 214D is received as a part of the foil operation status 522. In 640, one or more parameters are received from the foil pitch function 532.

In 642, 644, 646, a reference foil speed 810, a reference angular foil position 812, and a reference foil acceleration 814 for each foil 214A, 214B, 214C, 214D are generated based on the actual angular wheel position and the one or more parameters.

In 612, the reference torque 820 for each foil 214A, 214B, 214C, 214D is generated based on the reference foil speed 810, the reference angular foil position 812, and the reference foil acceleration 814 for each foil 214A, 214B, 214C, 214D.

In 648, adjusting 648 the reference torque 820 for each foil 214A, 214B, 214C, 214D is adjusted based on the actual foil torque 822 of each foil 214A, 214B, 214C, 214D.

Optionally, in 650, the reference foil speed 810 for each foil 214A, 214B, 214C, 214D is adjusted based on the actual foil speed 816 of each foil 214A, 214B, 214C, 214D.

Optionally, in 652, the reference angular foil position 812 for each foil 214A, 214B, 214C, 214D is adjusted based on the actual angular foil position 818 of each foil 214A, 214B, 214C, 214D.

Optionally, in 654, the reference foil acceleration 814 for each foil 214A, 214B, 214C, 214D is adjusted using an acceleration feedforward model 804.

Figure 7:
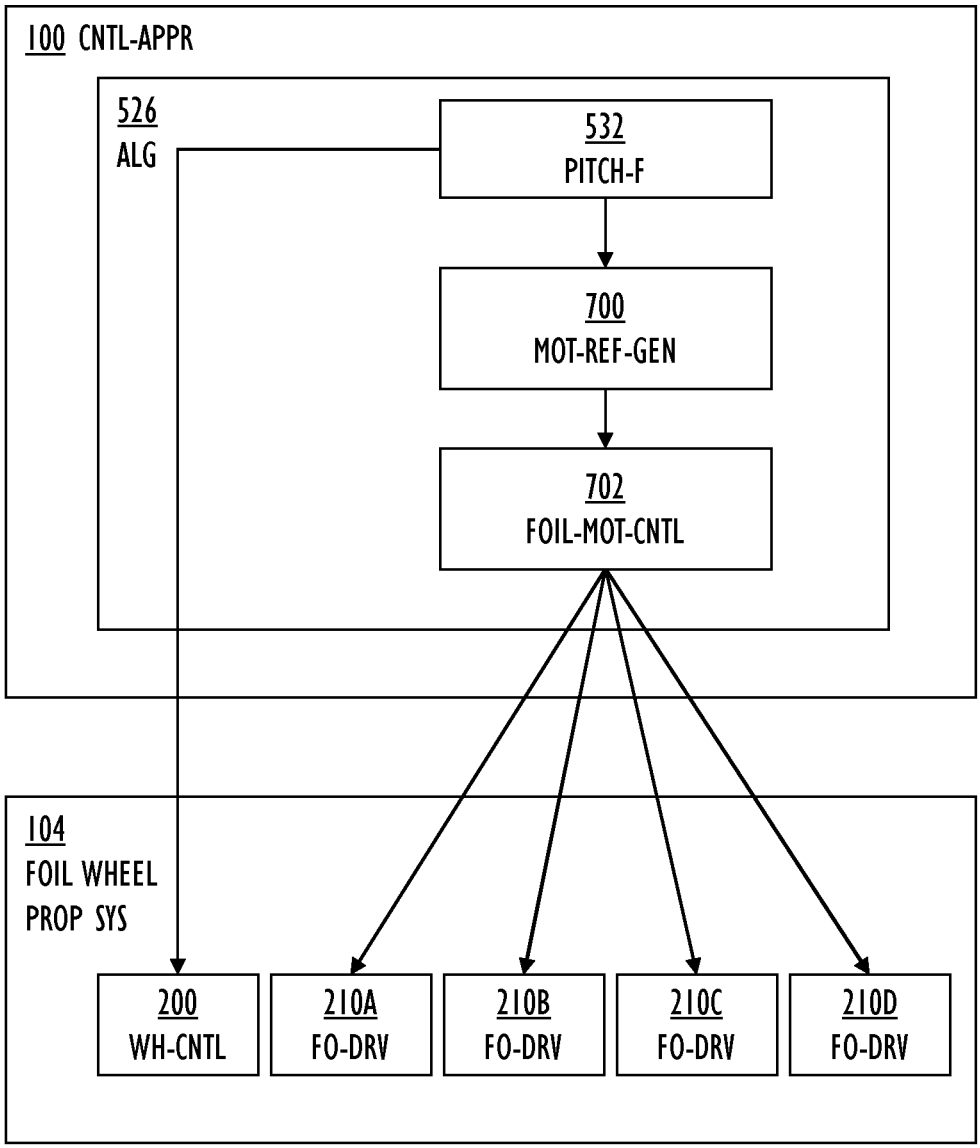
FIG. 7, FIG. 8 and FIG. 9 illustrate further embodiments of the apparatus for controlling propulsion of the marine vessel.
Figure 8:
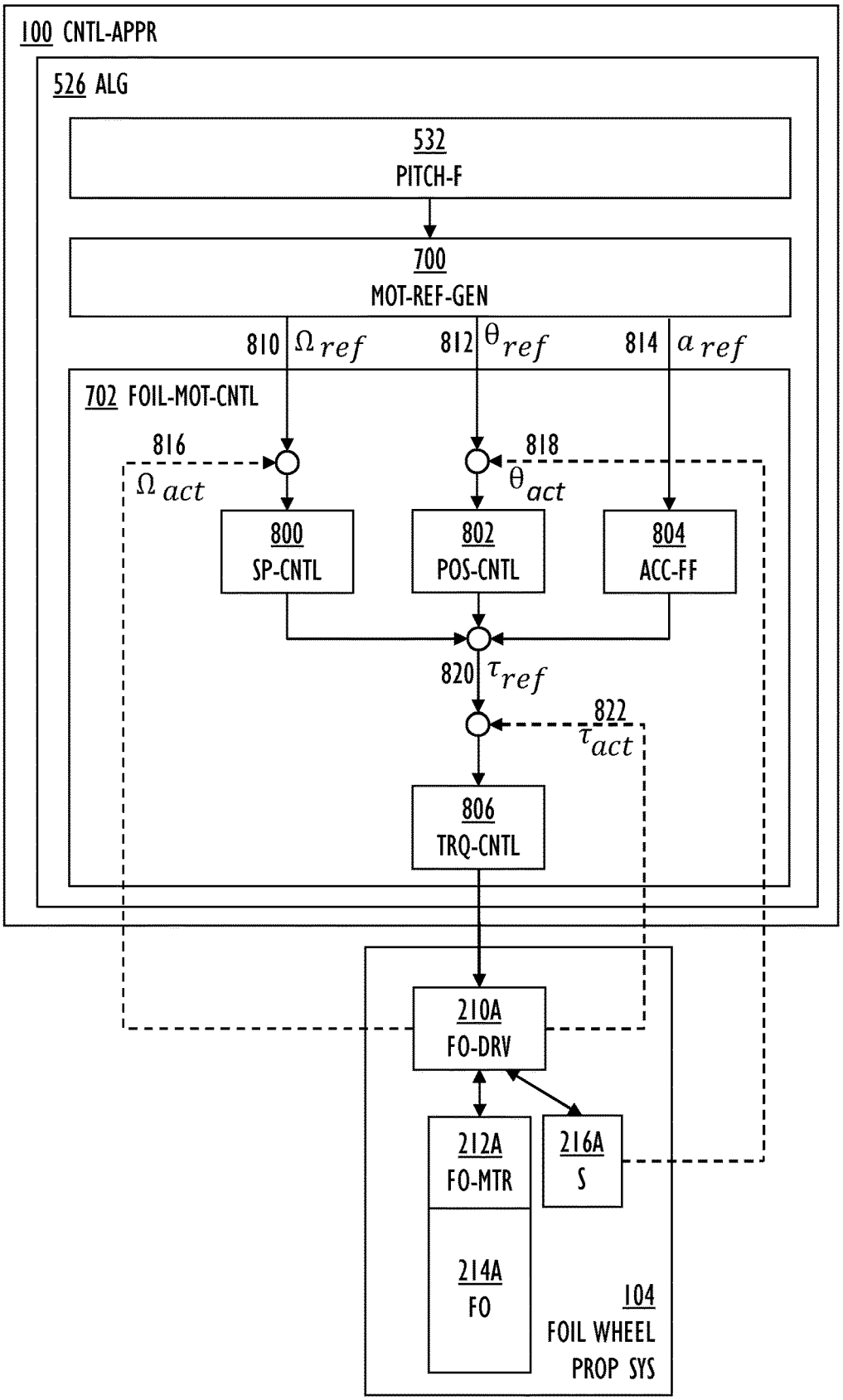

As shown in FIG. 7, the foil pitch function 532 provides the one or more parameters (such as set pitch function parameters) for the wheel controller 200 and to a propulsion control 700, 702 of the foil drives 210A, 210B, 210C, 210D.

In an embodiment, the propulsion control may be divided into two functional blocks: a motion reference generation block 700 and a foil motion control block 702. These blocks are illustrated in more detail in FIG. 8. The motion reference generation block 700 receives one or more parameters from the foil pitch function 532, and based on an actual angular wheel position $\theta_{wheel}$, generates a reference angular foil position $\theta_{foil_ref}$, a reference foil speed $\Omega_{foil_ref}$ and a reference foil acceleration $a_{foil_ref}$ for each foil 214A, 214B, 214C, 214D.

The foil pitch function 532 (i.e., a motion reference) may be a trochoidal function, cycloidal function, sinusoidal function, spline function, or any other type of suitable periodic function.

The period of the foil pitch function 532 is based on the actual angular wheel position $\theta_{wheel}$. Every revolution is one period. The wheel 204 is also rotating based on the one or more parameters. The one or more parameters for the wheel 204 may be a rotational speed, or a streaming of angular position, for example.

For example, if the foil pitch function 532 is a trochoidal function or a cycloidal function, the one or more parameters may be a combination of a reference wheel speed $\Omega_{wheel_ref}$, an eccentricity $e_c$ of the foil 214A, 214B, 214C, 214D, and a yaw angle $\psi$. Based on the actual angular wheel position $\theta_{wheel}$, the outputs of the motion reference generation block 700, a reference angular foil position $\theta_{foil_ref}$, a reference foil speed $\Omega_{foil_ref}$ and a reference foil acceleration $a_{foil_ref}$ may be defined with the equations 4, 5 and 6:

$$\theta_{foil_ref} = \tan^{-1}\left(\frac{S_e\cos(\theta_{wheel}+\psi)}{S_e + S_e e_c \sin(\theta_{wheel}+\psi)}\right) \tag{4}$$

$$\Omega_{foil_ref} = -\Omega_{wheel_ref}\frac{e_c^2 + e_c\sin(\theta_{wheel}+\psi)}{1+2\cdot e_c\cdot\sin(\theta_{wheel}+\psi)+e_c^2} \tag{5}$$

$$a_{foil_ref} = \frac{\Omega_{wheel_ref}^2\cdot e_c\cdot\cos(\theta_{wheel}+\psi)\cdot(e_c^2-1)}{(1+2\cdot e_c\cdot\sin(\theta_{wheel}+\psi)+e_c^2)^2}, \tag{6}$$

where:

$S_e$ is the sign of the eccentricity.

The foil motion control block 702 receives the reference angular foil position $\theta_{foil_ref}$, the reference foil speed $\Omega_{foil_ref}$ and the reference foil acceleration $a_{foil_ref}$, and based on the actual angular foil position $\theta_{foil_act}$, the actual foil speed $\Omega_{foil_act}$ and the actual torque $\tau_{act}$ (or a motor current), generates the reference torque $\tau_{ref}$ for each foil drive 210A, 210B, 210C, 210D. The blade motion control block 702 may be implemented centrally in the apparatus 100 as shown in FIG. 8, but it may also be implemented in a distributed fashion in each foil drive 210A, 210B, 210C, 210D.

In an embodiment, the foil motion control block 702 comprises a position control loop 818, 802, a speed control loop 816, 800, an acceleration feedforward 804 and a torque control loop 822, 806. The position control loop 818, 802 and the speed control loop 816, 800 may be connected in parallel as shown in FIG. 8, but they may also be connected in series. The output of these two loops 818, 802 and 816, 800 is added together with the acceleration feedforward 804 to set an input reference torque to the torque control loop 822, 806.

The position control loop 818, 802 and the torque control loop 822, 806 may be closed feedback loops. The acceleration feedforward 804 may be an open loop. The speed control loop 818, 800 may be the closed feedback loop as shown in FIG. 8, but it may be an open loop as well. The objective of the closed control loop is to minimize the error between the reference signal and the actual signal. The controller used in the closed control loops may be a PID (proportional-integral-derivative) controller, PI (proportional-integral) controller, P (proportional) controller, LQR (linear-quadratic regulator) controller, or any other type of a suitable feedback controller.

Figure 9:
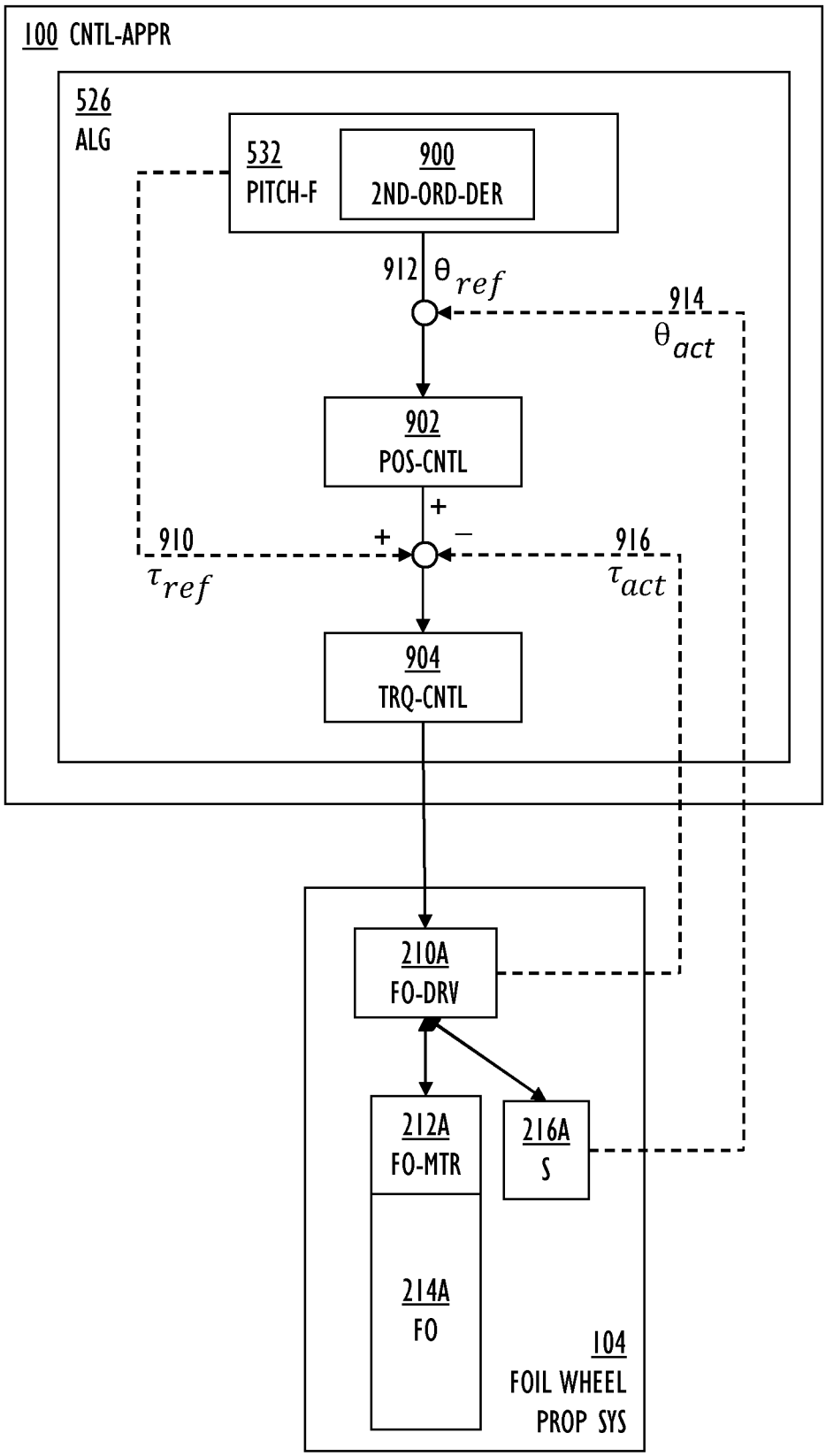

In an embodiment illustrated with reference to FIG. 9, the reference torque is generated 612 as follows.

In 656, a second order derivative 900 is applied on the foil pitch function 532 to generate a torque compensation command 910.

In 658, the torque compensation command is multiplied with a torque compensation constant to generate the reference torque 910 of the foil control data 530 for each foil drive 210A, 210B, 210C, 210D.

In calculus, the second order derivative 900 of a foil pitch function 532 is the derivative of the derivative of the foil pitch function 532. It may be said that the second derivative measures how the rate of change of a quantity is itself changing: the second derivative of the actual angular foil position with respect to time is an instantaneous acceleration of the foil 214A, 214B, 214C, 214D.

Such torque feedforward compensation may improve the pitch control accuracy. A torque compensation command is generated by a control of the foil pitch function 910. The second order derivative is applied on the foil pitch function 532, instead of its output, the reference angular foil position 912, or the actual angular foil position 914. The torque compensation command is multiplied with the torque compensation constant in order to obtain the reference torque 910. Note the reference angular foil position 912 and the actual angular foil position 914 inputted to a position control loop 914, 902, and also a torque control loop 916, 904.

Let us take a foil trochoidal pitch function 532 for example, but the embodiment may be applied also to other pitch functions. After the second order derivative has been applied on the foil trochoidal pitch function 532, the equation 7 is obtained:

$$a_{foil} = \frac{\Omega_{wheel}^2 \cdot e_c \cdot \cos(\theta_{wheel} + \psi) \cdot (e_c^2 - 1)}{(1 + 2e_c \cdot \sin(\theta_{wheel} + \psi) + e_c^2)^2}, \quad (7)$$

where:

$a_{foil}$ is the realized foil acceleration signal, $\Omega_{wheel}$ is the actual wheel speed, $e_c$ is an eccentricity of the foil, $\psi$ is the yaw angle, and $\theta_{wheel}$ is the actual angular wheel position.

Prior art torque feedforward compensation signals come either from an acceleration measurement or from an acceleration command. The compensation originates from the second derivative on the position measurement or position command. The problem is that both signals have noise and, consequently, their second derivate signals have also noise. The signal according to the embodiment gets rid of the noise problem compared to the prior art torque compensation methods.

In an embodiment illustrated with reference to FIG. 10A and FIG. 10B, the foil wheel propulsion system 104 may be utilized as a steering aid. Note that this embodiment may be used independent of all other described embodiments as a stand-alone embodiment.

In 660, a steering command is received from the vessel control system 106 instructing the foil wheel propulsion system 104 to steer the marine vessel 102.

In 608 and 610, wheel control data 528 for the wheel controller 200 and foil control data 530 for the plurality of the foil drives 210A, 210B, 210C, 210D is generated based on the steering command.

So, instead of, or in addition to the propulsion control, also steering control may be performed by the apparatus 100.

In an embodiment, if main propulsion is stopped or lost, individual foils 214A, 214B, 214C, 214D may be controlled like a rudder. The main propulsion may come from the rotation of the wheel 204, but also another propulsion unit may act as the main propulsion. The other propulsion unit may be another foil wheel propulsion system, or another type of a propulsion unit, such as a propeller or an azimuthing propulsion unit, for example. The steering force may be built up with a normal lift force of foils 214A, 214B, 214C, 214D. In this way, this embodiment implements a backup rudder function, but in some cases this embodiment may implement a (main) rudder function. Depending on the implementation, all or some manoeuvring capacity, depending on the available flow 1000 (=vessel speed), is available.

Figure 10A:
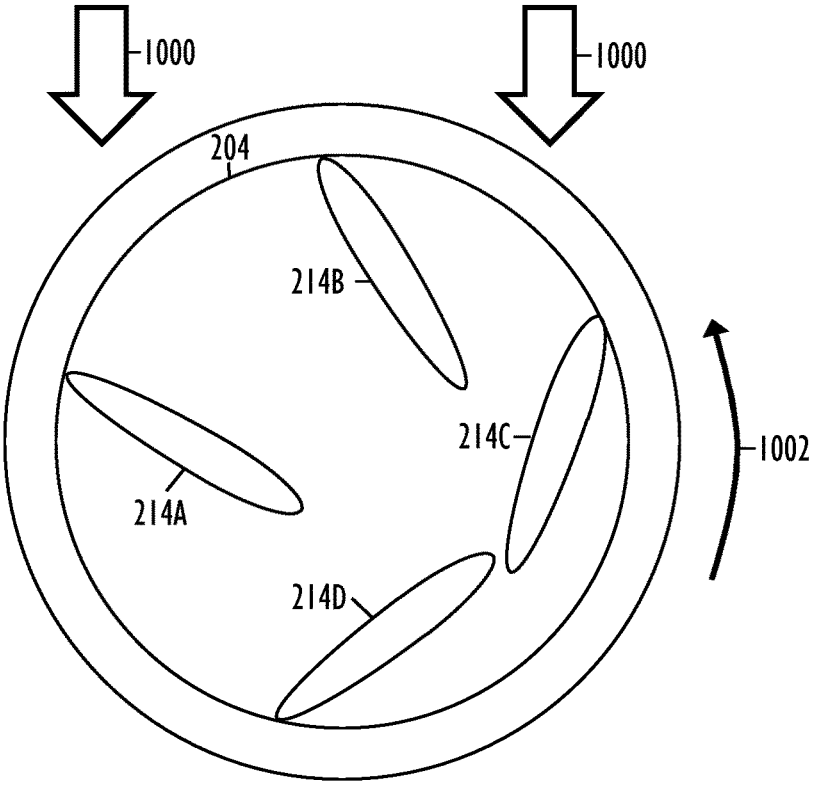
FIG. 10A and FIG. 10B illustrate further embodiments of the foil wheel propulsion system.

In a normal operation illustrated in FIG. 10A, the wheel 204 rotates 1002, and the foils 214A, 214B, 214C, 214D create thrust and steering force.

Figure 10B:
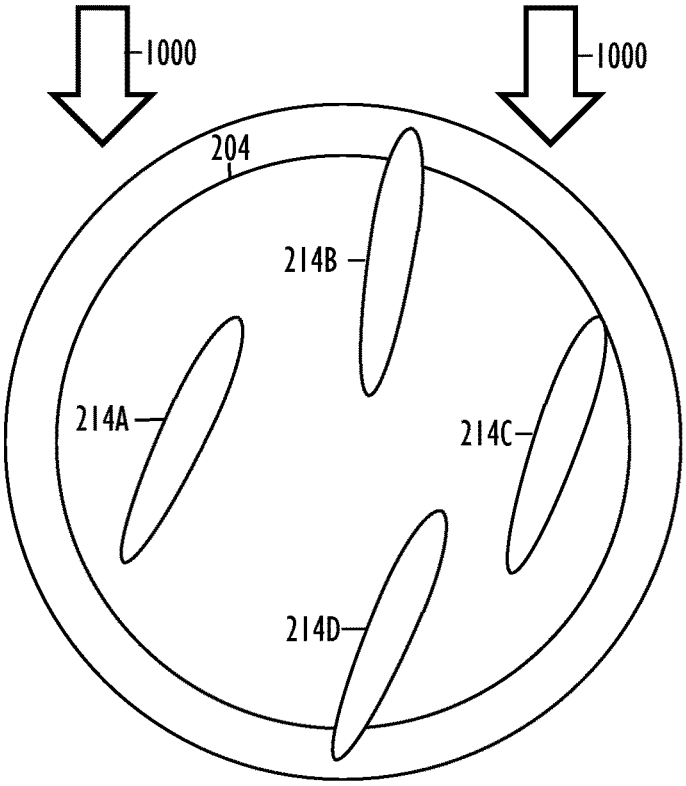

In an alternative operation illustrated in FIG. 10B, the rotation of the wheel 204 is stopped, whereby the propulsion is minimal and the foils 214A, 214B, 214C, 214D are controlled like rudder(s). Some amount of steering force will be available even when no thrust is available.

This embodiment may be used in a double-end ferry (with two or more foil wheel propulsion units 104), where the anterior foil wheel propulsion unit 104 is kept as a 'rudder' in order to minimize its drag since it is not efficient to produce the thrust due to big thrust deduction (in the front of vessel), whereas the posterior foil wheel propulsion unit 104 is used to generate the thrust. Also, vessels having at least two foil wheel propulsion units 104 (and for example a diesel-mechanical shaft connection to the propeller) may on lower speeds optimize a load for the operational diesel for lowest SFOC/kW (specific fuel oil consumption). In this way, the drag of the propeller may be minimized (giving possibilities to optimize loading for the power plant/diesels) or to be used for steering as a rudder.

Based on the steering command, the steering may be produced by having the wheel active 204 and foils 214A, 214B, 214C, 214D locked, or the wheel 204 locked and foils 214A, 214B, 214C, 214D active, or keeping the wheel 204 and foils 214A, 214B, 214C, 214D active. In the last option, an angle of attack may be chosen according to a wake-field producing the maximum lift (biggest side force for the steering). On lower speeds, the embodiment provides an analogy to a flap rudder improving the side force by utilizing a bigger angle for the foil 214A, 214B, 214C, 214D on the aft side. The term flap rudder refers to a multi-section rudder, wherein a hinged aft section acts as an additional control surface.

Even though the invention has been described with reference to one or more embodiments according to the accompanying drawings, it is clear that the invention is not restricted thereto but can be modified in several ways within the scope of the appended claims. All words and expressions should be interpreted broadly, and they are intended to illustrate, not to restrict, the embodiments. It will be obvious to a person skilled in the art that, as technology advances, the inventive concept can be implemented in various ways.

The invention claimed is:

1. An apparatus for controlling propulsion of a marine vessel, comprising:

a vessel interface couplable with a vessel control system;

a control interface to control a foil wheel propulsion system, which foil wheel propulsion system includes a rotatable wheel powered by a wheel motor and controlled by a wheel controller, a plurality of rotatable foils attached perpendicularly to the wheel, each foil powered by a foil motor and controlled by a foil drive, a wheel sensor to measure an actual angular wheel position of the wheel, and a plurality of foil sensors to measure an actual angular foil position of each foil;

one or more memories including computer program code; and one or more processors to execute the computer program code to cause the apparatus to perform at least the following:

receiving a wheel operation status from the wheel controller;

receiving a plurality of foil operation statuses from a plurality of foil drives;

receiving a command from the vessel control system;

generating wheel control data for the wheel controller to control a foil pitch function of the foil wheel propulsion system based on the command in view of the wheel operation status; and generating foil control data for the plurality of the foil drives to further control the foil pitch function of the foil wheel propulsion system based on the command in view of the wheel operation status and the plurality of foil operation statuses, wherein a reference torque of the foil control data for each foil drive is generated using a foil feedforward model, wherein the apparatus is caused to perform:

receiving the actual angular wheel position as a part of the wheel operation status;

receiving an actual wheel speed as a part of the wheel operation status, or generating the actual wheel speed based on a plurality of actual angular wheel positions;

receiving a reference angular foil position for each foil as a part of the foil operation status;

receiving a reference foil speed for each foil as a part of the foil operation status;

receiving a reference foil acceleration for each foil as a part of the foil operation status; and generating the reference torque of the foil control data for each foil drive using the feedforward model, whose inputs are the actual angular wheel position, the reference angular foil position, the actual wheel speed, the reference foil speed, and the reference foil acceleration, and the reference torque is modified by a position feedback torque describing a difference in torque between the reference angular foil position and the actual angular foil position, and by a speed feedback torque describing a difference in torque between the reference foil speed and the actual foil speed.

2. An apparatus for controlling propulsion of a marine vessel, comprising:

a vessel interface couplable with a vessel control system;

a control interface to control a foil wheel propulsion system, which foil wheel propulsion system includes a rotatable wheel powered by a wheel motor and controlled by a wheel controller, a plurality of rotatable foils attached perpendicularly to the wheel, each foil powered by a foil motor and controlled by a foil drive, a wheel sensor to measure an actual angular wheel position of the wheel, and a plurality of foil sensors to measure an actual angular foil position of each foil;

one or more memories including computer program code; and one or more processors to execute the computer program code to cause the apparatus to perform at least the following:

receiving a wheel operation status from the wheel controller;

receiving a plurality of foil operation statuses from a plurality of foil drives:

receiving a command from the vessel control system;

generating wheel control data for the wheel controller to control a foil pitch function of the foil wheel propulsion system based on the command in view of the wheel operation status; and generating foil control data for the plurality of the foil drives to further control the foil pitch function of the foil wheel propulsion system based on the command in view of the wheel operation status and the plurality of foil operation statuses, wherein a reference torque of the foil control data for each foil drive is generated using a foil feedforward model, wherein the apparatus is caused to perform:

receiving the actual angular wheel position as a part of the wheel operation status;

receiving the actual angular foil position for each foil as a part of the foil operation status;

receiving an actual foil speed as a part of the foil operation status, or generating the actual foil speed based on a plurality of actual angular foil positions;

receiving an actual foil torque for each foil as a part of the foil operation status;

receiving one or more parameters from the foil pitch function;

generating a reference foil speed, a reference angular foil position, and a reference foil acceleration for each foil based on the actual angular wheel position and the one or more parameters;

generating the reference torque for each foil based on the reference foil speed, the reference angular foil position, and the reference foil acceleration for each foil; and adjusting the reference torque for each foil based on the actual foil torque of each foil.

3. The apparatus of claim 2, wherein the apparatus is caused to perform:

adjusting the reference foil speed for each foil based on the actual foil speed of each foil;

adjusting the reference angular foil position for each foil based on the actual angular foil position of each foil; and adjusting the reference foil acceleration for each foil using an acceleration feedforward model.

4. An apparatus for controlling propulsion of a marine vessel, comprising:

a vessel interface couplable with a vessel control system;

a control interface to control a foil wheel propulsion system, which foil wheel propulsion system includes a rotatable wheel powered by a wheel motor and controlled by a wheel controller, a plurality of rotatable foils attached perpendicularly to the wheel, each foil powered by a foil motor and controlled by a foil drive, a wheel sensor to measure an actual angular wheel position of the wheel, and a plurality of foil sensors to measure an actual angular foil position of each foil;

one or more memories including computer program code; and one or more processors to execute the computer program code to cause the apparatus to perform at least the following;

receiving a wheel operation status from the wheel controller;

receiving a plurality of foil operation statuses from a plurality of foil drives;

receiving a command from the vessel control system;

generating wheel control data for the wheel controller to control a foil pitch function of the foil wheel propulsion system based on the command in view of the wheel operation status; and generating foil control data for the plurality of the foil drives to further control the foil pitch function of the foil wheel propulsion system based on the command in view of the wheel operation status and the plurality of foil operation statuses, wherein a reference torque of the foil control data for each foil drive is generated using a foil feedforward model, wherein the apparatus is caused to perform:

applying a second order derivative on the foil pitch function to generate a torque compensation command; and multiplying the torque compensation command with a torque compensation constant to generate the reference torque of the foil control data for each foil drive.

5. The apparatus of claim 4, wherein the apparatus is caused to perform:

receiving a steering command from the vessel control system instructing the foil wheel propulsion system to steer the marine vessel; and generating, based on the steering command, wheel control data for the wheel controller and foil control data for the plurality of the foil drives.

6. The apparatus of claim 4, wherein the wheel motor is an electric motor, and the wheel controller is a wheel drive configured to control electric energy sent to the electric motor.

7. The apparatus of claim 4, wherein the wheel motor is an engine, and the wheel controller is configured to electrically control the engine.

8. A method for controlling propulsion of a marine vessel, the propulsion being at least partly implemented by a foil wheel propulsion system, which foil wheel propulsion system includes a rotatable wheel powered by a wheel motor and controlled by a wheel drive, a plurality of rotatable foils attached perpendicularly to the wheel, each foil powered by a foil motor and controlled by a foil drive, a wheel sensor to measure an actual angular wheel position of the wheel, and a plurality of foil sensors to measure an actual angular foil position of each foil, the method comprising:

receiving a wheel operation status from the wheel drive;

receiving a plurality of foil operation statuses from a plurality of foil drives;

receiving a command from the vessel control system;

generating wheel control data for the wheel drive to control a foil pitch function of the foil wheel propulsion system based on the command in view of the wheel operation status; and generating foil control data for the plurality of the foil drives to further control the foil pitch function of the foil wheel propulsion system based on the command in view of the wheel operation status and the plurality of foil operation statuses, wherein a reference torque of the foil control data for each foil drive is generated using a foil feedforward model, further comprising:

receiving the actual angular wheel position as a part of the wheel operation status;

receiving an actual wheel speed as a part of the wheel operation status, or generating the actual wheel speed based on a plurality of actual angular wheel positions;

receiving a reference angular foil position for each foil as a part of the foil operation status;

receiving a reference foil speed for each foil as a part of the foil operation status;

receiving a reference foil acceleration for each foil as a part of the foil operation status; and generating the reference torque of the foil control data for each foil drive using the feedforward model, whose inputs are the actual angular wheel position, the reference angular foil position, the actual wheel speed, the reference foil speed, and the reference foil acceleration, and the reference torque is modified by a position feedback torque describing a difference in torque between the reference angular foil position and the actual angular foil position, and by a speed feedback torque describing a difference in torque between the reference foil speed and the actual foil speed.

9. A method for controlling propulsion of a marine vessel, the propulsion being at least partly implemented by a foil wheel propulsion system, which foil wheel propulsion system includes a rotatable wheel powered by a wheel motor and controlled by a wheel drive, a plurality of rotatable foils attached perpendicularly to the wheel, each foil powered by a foil motor and controlled by a foil drive, a wheel sensor to measure an actual angular wheel position of the wheel, and a plurality of foil sensors to measure an actual angular foil position of each foil, the method comprising:

receiving a wheel operation status from the wheel drive;

receiving a plurality of foil operation statuses from a plurality of foil drives;

receiving a command from the vessel control system;

generating wheel control data for the wheel drive to control a foil pitch function of the foil wheel propulsion system based on the command in view of the wheel operation status; and generating foil control data for the plurality of the foil drives to further control the foil pitch function of the foil wheel propulsion system based on the command in view of the wheel operation status and the plurality of foil operation statuses, wherein a reference torque of the foil control data for each foil drive is generated using a foil feedforward model, further comprising:

receiving the actual angular wheel position as a part of the wheel operation status;

receiving the actual angular foil position for each foil as a part of the foil operation status;

receiving an actual foil speed as a part of the foil operation status, or generating the actual foil speed based on a plurality of actual angular foil positions;

receiving an actual foil torque for each foil as a part of the foil operation status;

receiving one or more parameters from the foil pitch function;

generating a reference foil speed, a reference angular foil position, and a reference foil acceleration for each foil based on the actual angular wheel position and the one or more parameters;

generating the reference torque for each foil based on the reference foil speed, the reference angular foil position, and the reference foil acceleration for each foil; and adjusting the reference torque for each foil based on the actual foil torque of each foil.

10. The method of claim 9, further comprising:

adjusting the reference foil speed for each foil based on the actual foil speed of each foil;

adjusting the reference angular foil position for each foil based on the actual angular foil position of each foil; and adjusting the reference foil acceleration for each foil using an acceleration feedforward model.

11. A method for controlling propulsion of a marine vessel, the propulsion being at least partly implemented by a foil wheel propulsion system, which foil wheel propulsion system includes a rotatable wheel powered by a wheel motor and controlled by a wheel drive, a plurality of rotatable foils attached perpendicularly to the wheel, each foil powered by a foil motor and controlled by a foil drive, a wheel sensor to measure an actual angular wheel position of the wheel, and a plurality of foil sensors to measure an actual angular foil position of each foil, the method comprising:

receiving a wheel operation status from the wheel drive;

receiving a plurality of foil operation statuses from a plurality of foil drives;

receiving a command from the vessel control system;

generating wheel control data for the wheel drive to control a foil pitch function of the foil wheel propulsion system based on the command in view of the wheel operation status; and generating foil control data for the plurality of the foil drives to further control the foil pitch function of the foil wheel propulsion system based on the command in view of the wheel operation status and the plurality of foil operation statuses, wherein a reference torque of the foil control data for each foil drive is generated using a foil feedforward model, further comprising:

applying a second order derivative on the foil pitch function to generate a torque compensation command; and multiplying the torque compensation command with a torque compensation constant to generate the reference torque of the foil control data for each foil drive.

12. The method of claim 9, further comprising:

receiving a steering command from the vessel control system instructing the foil wheel propulsion system to steer the marine vessel; and generating, based on the steering command, wheel control data for the wheel drive and foil control data for the plurality of the foil drives.

13. A computer-readable medium comprising computer program code, which, when executed by one or more processors, causes performance of a method for controlling propulsion of a marine vessel, the propulsion being at least partly implemented by a foil wheel propulsion system, which foil wheel propulsion system includes a rotatable wheel powered by a wheel motor and controlled by a wheel drive, a plurality of rotatable foils attached perpendicularly to the wheel, each foil powered by a foil motor and controlled by a foil drive, a wheel sensor to measure an actual angular wheel position of the wheel, and a plurality of foil sensors to measure an actual angular foil position of each foil, the method comprising:

receiving a plurality of foil operation statuses from a plurality of foil drives;

receiving a command from the vessel control system;

generating wheel control data for the wheel drive to control a foil pitch function of the foil wheel propulsion system based on the command in view of the wheel operation status;

generating foil control data for the plurality of the foil drives to further control the foil pitch function of the foil wheel propulsion system based on the command in view of the wheel operation status and the plurality of foil operation statuses, wherein a reference torque of the foil control data for each foil drive is generated using a foil feedforward model;

receiving the actual angular wheel position as a part of the wheel operation status;

receiving an actual wheel speed as a part of the wheel operation status, or generating the actual wheel speed based on a plurality of actual angular wheel positions;

receiving a reference angular foil position for each foil as a part of the foil operation status;

receiving a reference foil speed for each foil as a part of the foil operation status;

receiving a reference foil acceleration for each foil as a part of the foil operation status; and generating the reference torque of the foil control data for each foil drive using the feedforward model, whose inputs are the actual angular wheel position, the reference angular foil position, the actual wheel speed, the reference foil speed, and the reference foil acceleration, and the reference torque is modified by a position feedback torque describing a difference in torque between the reference angular foil position and the actual angular foil position, and by a speed feedback torque describing a difference in torque between the reference foil speed and the actual foil speed.

14. A computer-readable medium comprising computer program code, which, when executed by one or more processors, causes performance of a method for controlling propulsion of a marine vessel, the propulsion being at least partly implemented by a foil wheel propulsion system, which foil wheel propulsion system includes a rotatable wheel powered by a wheel motor and controlled by a wheel drive, a plurality of rotatable foils attached perpendicularly to the wheel, each foil powered by a foil motor and controlled by a foil drive, a wheel sensor to measure an actual angular wheel position of the wheel, and a plurality of foil sensors to measure an actual angular foil position of each foil, the method comprising:

receiving a plurality of foil operation statuses from a plurality of foil drives;

receiving a command from the vessel control system;

generating wheel control data for the wheel drive to control a foil pitch function of the foil wheel propulsion system based on the command in view of the wheel operation status;

generating foil control data for the plurality of the foil drives to further control the foil pitch function of the foil wheel propulsion system based on the command in view of the wheel operation status and the plurality of foil operation statuses, wherein a reference torque of the foil control data for each foil drive is generated using a foil feedforward model;

receiving the actual angular wheel position as a part of the wheel operation status;

receiving the actual angular foil position for each foil as a part of the foil operation status;

receiving an actual foil speed as a part of the foil operation status, or generating the actual foil speed based on a plurality of actual angular foil positions;

receiving an actual foil torque for each foil as a part of the foil operation status;

receiving one or more parameters from the foil pitch function;

generating a reference foil speed, a reference angular foil position, and a reference foil acceleration for each foil based on the actual angular wheel position and the one or more parameters;

generating the reference torque for each foil based on the reference foil speed, the reference angular foil position, and the reference foil acceleration for each foil; and adjusting the reference torque for each foil based on the actual foil torque of each foil.

15. A computer-readable medium comprising computer program code, which, when executed by one or more processors, causes performance of a method for controlling propulsion of a marine vessel, the propulsion being at least partly implemented by a foil wheel propulsion system, which foil wheel propulsion system includes a rotatable wheel powered by a wheel motor and controlled by a wheel drive, a plurality of rotatable foils attached perpendicularly to the wheel, each foil powered by a foil motor and controlled by a foil drive, a wheel sensor to measure an actual angular wheel position of the wheel, and a plurality of foil sensors to measure an actual angular foil position of each foil, the method comprising:

receiving a plurality of foil operation statuses from a plurality of foil drives;

receiving a command from the vessel control system;

generating wheel control data for the wheel drive to control a foil pitch function of the foil wheel propulsion system based on the command in view of the wheel operation status;

generating foil control data for the plurality of the foil drives to further control the foil pitch function of the foil wheel propulsion system based on the command in view of the wheel operation status and the plurality of foil operation statuses, wherein a reference torque of the foil control data for each foil drive is generated using a foil feedforward model;

applying a second order derivative on the foil pitch function to generate a torque compensation command; and multiplying the torque compensation command with a torque compensation constant to generate the reference torque of the foil control data for each foil drive.

* * * * *